US012225963B2

(12) United States Patent
Sherlock et al.

(10) Patent No.: US 12,225,963 B2
(45) Date of Patent: Feb. 18, 2025

(54) SUCTION RELEASING SYSTEM FOR SHOES

(71) Applicants: Michael Sherlock, White City, OR (US); Katrina Sherlock, White City, OR (US)

(72) Inventors: Michael Sherlock, White City, OR (US); Katrina Sherlock, White City, OR (US)

( * ) Notice: Subject to any disclaimer, the term of this patent is extended or adjusted under 35 U.S.C. 154(b) by 41 days.

(21) Appl. No.: 18/045,249

(22) Filed: Oct. 10, 2022

(65) Prior Publication Data

US 2023/0210217 A1 Jul. 6, 2023

Related U.S. Application Data

(60) Provisional application No. 63/294,963, filed on Dec. 30, 2021.

(51) Int. Cl.
*A43B 13/14* (2006.01)
*A43B 3/00* (2022.01)

(52) U.S. Cl.
CPC ..... *A43B 13/14* (2013.01); *A43B 3/0036* (2013.01)

(58) Field of Classification Search
CPC ..... A43B 13/14; A43B 13/16; A43B 13/26; A43B 23/227; A43B 5/08; A43B 3/0026; A43B 7/087; A43B 7/10; A43C 15/00; A43C 15/02; A43C 15/068; A61F 5/0102
See application file for complete search history.

(56) References Cited

U.S. PATENT DOCUMENTS

| | | | | |
|---|---|---|---|---|
| 2,402,334 A * | 6/1946 | Marks | A43B 3/16 36/4 |
| 2,708,320 A * | 5/1955 | Hilton | A43B 7/06 36/3 R |
| 4,525,941 A * | 7/1985 | Ruth, Jr. | A43B 5/18 36/116 |
| 2005/0183290 A1* | 8/2005 | Cantrell | A43B 3/0026 36/116 |
| 2006/0059722 A1* | 3/2006 | Jarriel | A43B 3/00 36/116 |
| 2016/0058125 A1* | 3/2016 | Martin, Sr. | A43B 3/00 36/136 |
| 2018/0199662 A1* | 7/2018 | Meacock | A43B 7/085 |

* cited by examiner

*Primary Examiner* — Jillian K Pierorazio
(74) *Attorney, Agent, or Firm* — Brennan, Manna & Diamond, LLC

(57) ABSTRACT

The present invention relates to a system integrated or retrofitted to a shoe for preventing a wearer of the shoe from becoming stuck in mud, sand, water, or any other soft terrain while walking. The system includes a pair of tubes positioned on opposing sides of the shoe/boot and a rigid attachment overlapping a portion of the sole of the shoe. A valve having a lengthwise opening can be placed between the rigid attachment and the sole such that each tube of the pair of tubes is attached to opposing ends of the valve using a pair of elbow tubes. Each elbow tube passes through a hole in the rigid attachment to connect to the valve. The valve creates a vacuum when the shoe to which the system is attached is stepped onto the terrain and when the shoe is lifted, the vacuum is released.

10 Claims, 4 Drawing Sheets

SUCTION RELEASING SYSTEM FOR SHOES

CROSS-REFERENCE TO RELATED APPLICATION

The present application claims priority to, and the benefit of, U.S. Provisional Application No. 63/294,963, which was filed on Dec. 30, 2021, and is incorporated herein by reference in its entirety.

FIELD OF THE INVENTION

The present invention relates generally to the field of wading and hiking boots. More specifically, the present invention relates to a novel system designed for shoes to prevent individuals from becoming stuck in mud or other terrain while walking. A shoe integrated with the system is also embodied in the disclosure and the system is configured to release a vacuum created underneath the sole when a shoe is stepped in mud, water, or other rough terrain. The system has a valve underneath the sole and is connected to a pair of tubes positioned on opposing sides of the shoe to release the vacuum. Accordingly, the present disclosure makes specific reference thereto. Nonetheless, it is to be appreciated that aspects of the present invention are also equally applicable to other like applications, devices and methods of manufacture.

BACKGROUND

By way of background, individuals may find it difficult to walk through waterlogged and muddy streets and trails, while going to their desired places. Individuals may be reluctant in walking through such roads, especially in rainy seasons. Individuals living in areas with rainy and wet climate conditions may regularly face issues of uncomfortable walking through muddy streets/trails. Even if individuals wear their wading boots, it may still be difficult to cross such wet streets/trails. While wearing the traditional boots or wading boots, individuals may get stuck in the middle of the muddy trail or waterlogged street, as the currently available boots create a suction under its surface and the muddy area, that prevents an individual from taking either forward or backward steps on the streets/trail/, thereby causing the individual to end up stepping out of their boots when in mud. Walking in mud can be incredibly exhausting and taxing on the lower body.

Further, walking through muddy roads can be time consuming and individuals may not be able to reach their desired destination expeditiously. Once stuck in the middle of the muddy streets/trails, it wastes a lot of time of the user. Also, in case there is any emergency or urgent meetings, individuals may fail to reach the required occasion expeditiously. Individuals may feel unhappy and disheartened at the end.

In addition to the above-mentioned problems, individuals may get dirty while walking through muddy and waterlogged streets/trails and may not look appropriate to attend occasions that require the individuals to dress in a desired attire. Also, with dirty clothes, individuals may be uncomfortable in attending the office, colleges, schools, and other similar places as well.

Therefore, there exists a long-felt need in the art for a pair of boots that enables the users to comfortably walk through muddy and waterlogged streets. There is also a long-felt need in the art for boots that prevents the users from becoming stuck in the middle of the muddy streets/trails and prevents them from taking off their boots to walk through the muddy roads. Additionally, there is a long-felt need in the art for boots that do not create suction when it comes in contact with muddy, sandy, or waterlogged areas. Moreover, there is a long-felt need in the art for boots that prevents the users from walking bare foot in muddy streets/trails and prevents them from becoming exhausted. Further, there is a long-felt need in the art for boots that enables the users to quickly walk-through muddy streets/trails without wasting their time. Furthermore, there is a long-felt need in the art for boots that enables the users to reach their desired destination expeditiously and desired attire. There is a long-felt need in the art for boots that prevents the clothes of the users from becoming dirty after walking through muddy streets/trails. Finally, there is a long-felt need in the art for boots that maintain traction when walking in mud, water, sand, or other sticky surfaces.

The subject matter disclosed and claimed herein, in one embodiment thereof, comprises a system designed to prevent individuals from becoming stuck in mud or other terrain while walking. The system can be integrally or removably attached to any boot and is especially useful for farmers, ranchers, anglers, hunters, and more. More specifically, the system has a pair of tubes positioned at opposite sides of the tongue of a shoe and the tubes extend to the sole, a metal plate is integrated to the sole of the shoe such that the metal plate creates an arch between the sole and therebetween, a hollow valve is positioned between the sole and the metal plate, a first tube of the pair of tubes is attached to one end of the valve using a first elbow tube, a second tube of the pair of the tubes is attached to the opposite end of the valve using a second elbow tube, the valve has a lengthwise cut for releasing a suction when a foot in which the boot is being worn is lifted from the water, mud, sand, or waterlogged terrain. The cut is closed when the foot covered by the boot is stepped in mud for creating a vacuum in the valve and the cut is opened for releasing the vacuum when the foot is lifted from the mud. The diameter of the valve is smaller than the diameter of the elbow pipes whose diameters in turn are smaller than diameters of the tubes.

In this manner, the system and system equipped boot of the present invention accomplishes all of the forgoing objectives and provides users with a system that relieves suction under the boots while walking in water, sand, or mud, preventing individuals from becoming stuck. The system alleviates excessive pressure when walking in water, sand, or mud and saves time and effort. The boots can be easily worn in all types of rough terrains and eliminates requirement of taking off boots while preserving energy of the wearer.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a boot designed to prevent individuals from becoming stuck in mud, sand, or other terrain while walking. The boot is especially useful for farmers, ranchers, anglers, hunters, and more for saving time and effort while walking in water, mud, sand, or rough terrain. More specifically, the boot has a pair of tubes at opposite sides of the tongue extending to the sole, a metal plate integrated to the sole of the shoe, such that the metal plate, creates an arch between the sole and therebetween, a valve positioned between the sole and the metal plate, a first tube of the pair of tubes is attached to one end of the valve using a first elbow tube, a second tube of the pair of the tubes is attached to the opposite end of the valve using a second elbow tube, the valve includes a lengthwise cut for releasing a suction when a foot in which the boot is being worn is lifted from the water, mud, sand, or rough terrain. The cut is closed when the foot covered by the boot is stepped in mud/sand for creating a vacuum in the valve and the cut is opened for releasing the vacuum when the foot is lifted from the mud/sand.

In yet another embodiment, a multifunctional system for a wading, work, or hiking shoe/boot is disclosed. The system is designed to prevent wearer of the shoes from becoming stuck in mud or other rough terrains. The system can be releasably or integrally attached to any shoes for alleviating excessive pressure while walking in mud, sand, water, or other terrains. The system features tubing that runs down each side of a boot, a metal plate overlapping a portion of the sole and fastened to the side of the sole, the metal plate having a pair of opposite openings, a valve having a lengthwise cut positioned between the metal plate and the sole, a first tube of the tubing connected to the valve using a first elbow tube wherein the first elbow tube passes through a first opening of the pair of opposite openings and extends between the first tube and the valve, a second tube of the tubing connected to the valve using a second elbow tube wherein the second elbow tube passes through a second opening of the pair of opposite openings and extends between the second tube and the valve, the lengthwise cut is configured to close the valve for creating a vacuum when the shoe on which the system is attached is stepped onto a terrain and is configured to release the vacuum when the shoe is lifted thereby alleviating excessive pressure and preventing a wearer of the shoe from becoming stuck.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figures 1, 1A:
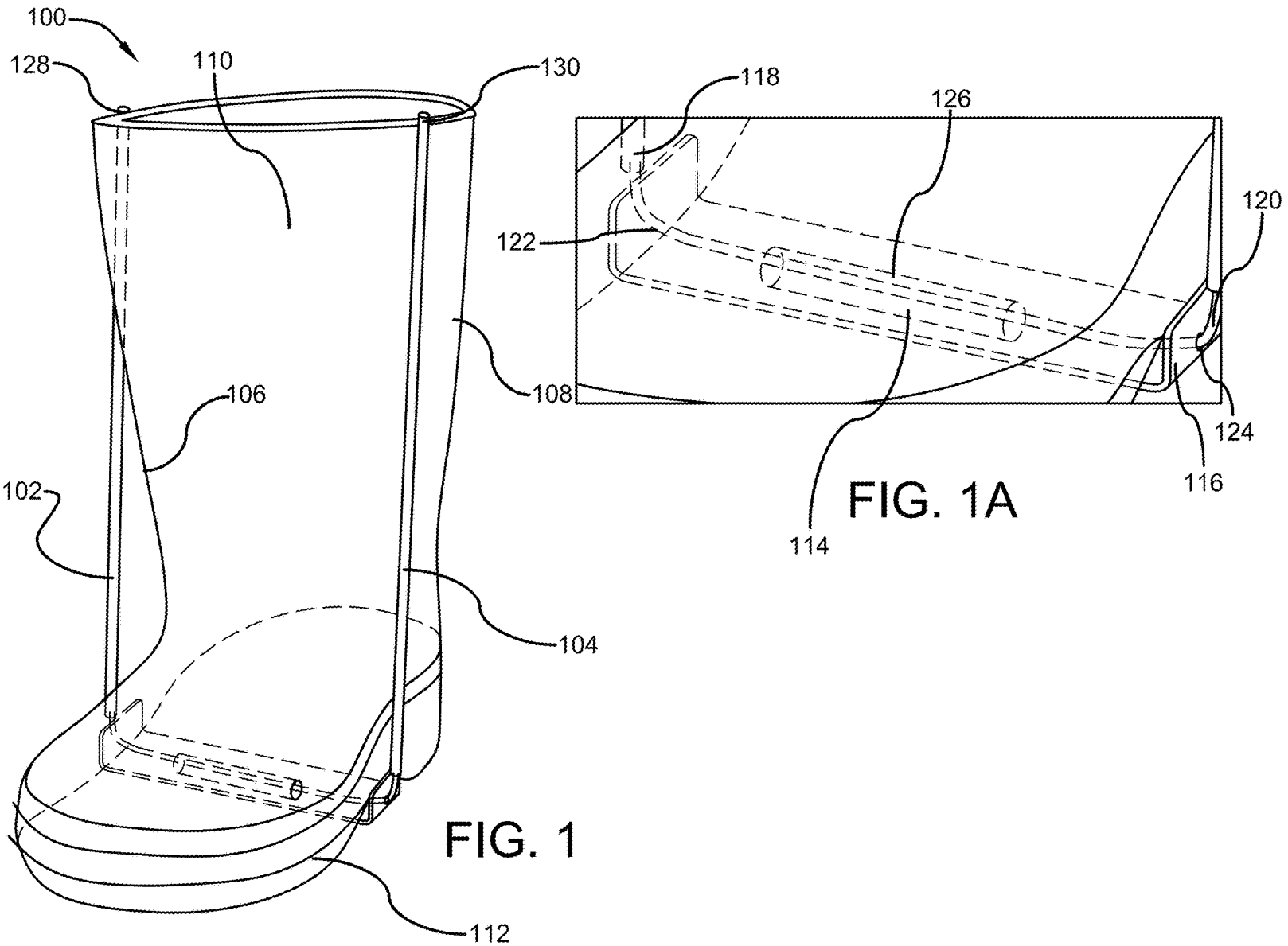
FIG. 1 illustrates a perspective view of one potential embodiment of an improved shoe/boot of the present invention in accordance with the disclosed architecture.
FIG. 1A illustrates a magnified view of the bottom portion of the improved shoe/boot of FIG. 1 in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a pair of boots that enables the users to comfortably walk through muddy, sandy, and waterlogged streets. There is also a long-felt need in the art for shoes/boots that prevents the users from becoming stuck in the middle of the muddy streets/trails and prevents them from taking off their boots to walk through the muddy roads. Additionally, there is a long-felt need in the art for boots that do not create suction when it comes in contact with muddy, sandy, or waterlogged areas. Moreover, there is a long-felt need in the art for shoes/boots that prevents the users from walking bare foot in muddy streets/trails and prevents them from being exhausted. Further, there is a long-felt need in the art for shoes/boots that enables the users to quickly walk-through muddy streets/trails without wasting their time. Furthermore, there is a long-felt need in the art for shoes/boots that enables the users to reach their desired destination expeditiously and with desired attire. There is a long-felt need in the art for shoes/boots that prevents the clothes of the users from becoming dirty after walking through muddy streets/trails. Finally, there is a long-felt need in the art for shoes/boots that maintain traction when walking in mud, sand, water, or other sticky surfaces.

The present invention, in one exemplary embodiment, is a multifunctional system for wading and hiking shoes. The system can be releasably or integrally attached to any shoes/boots for alleviating excessive pressure while walking in mud, sand, water or other terrains. The system has tubing on each side of a boot, a metal or rigid attachment overlapping a portion of the sole and fastened to the side of the sole, the metal attachment having a pair of opposite openings, a valve having a lengthwise cut positioned between the metal plate and the sole, a first tube of the tubing connected to the valve using a first elbow tube wherein the first elbow tube passes through a first opening of the pair of opposite openings and extends between the first tube and the valve, a second tube of the tubing connected to the valve using a second elbow tube wherein the second elbow tube passes through a second opening of the pair of opposite openings and extends between the second tube and the valve, the lengthwise cut is configured to close the valve for creating a vacuum when the shoe/boot on which the system is attached is stepped onto a terrain and is configured to release the vacuum when the shoe is lifted.

Referring initially to the drawings, FIGS. 1 and 1A illustrate a perspective view of one potential embodiment of a suction relieving boot of the present invention in accordance with the disclosed architecture. The suction relieving boot 100 of the present embodiment is designed to help a wearer of the boot 100 walking in water, sand, or mud without getting stuck in the mud or other terrain. The boot 100 can be designed in different sizes and can be used by farmers, ranchers, anglers, hunters, and more for alleviating excessive pressure when walking in water, sand, or mud. More specifically, the boot 100 can be in the shape of a wading boot, hiking boot, garden boot, rubber rain boot, and the like and includes a pair of tubes 102, 104 positioned on opposite sides 106, 108 of the tongue 110 of the shoe 100. The suction relieving boot 100 may be comprised of metal, leather, rubber or any other suitable material.

The tubes 102, 104 are independent tubes and each tube extend till the sole 112 of the shoe 100 such that the tubes 102, 104 are connected to a valve 114 positioned below the sole 112. A metal or rigid attachment 116 extending across the sole 112 is integrated or removably attached to the shoe 100. The metal attachment 116 is preferably a rectangular metal sheet and is fastened to the shoe 100 using a pair of mechanical fasteners such as screws, nuts, and bolts. The first tube 102 is attached to the valve 114 using a first tube elbow 118 and the second tube 104 is attached to the valve 114 from the opposite side using a second tube elbow 120. The first tube elbow 116 passes through a first opening 122 positioned in the metal attachment 116 to connect the first tube 102 to the valve 114. Similarly, the second tube elbow 118 extends through an opposite opening 124 of the metal attachment 116 to connect the second tube 104 to the valve 114.

In the preferred embodiment, the tube diameter of the valve 114 is smaller than diameter of the elbow tubes 118, 120 and is cut in half lengthwise to form a continuous slit 126 between the elbows 116, 118. The continuous slit 126 of the valve 114 is designed to be closed when a wearer of the shoe 100 steps down with the foot in which the shoe 100 is worn and when the foot is lifted, the valve is opened to relieve the vacuum, thereby preventing the foot from becoming stuck in mud or other terrain. When the foot is lifted, the mud/air passes through the elbow tubes 118, 120 to the tubes 102, 104 respectively, and is released through the top opening 128 of first tube 102 and top opening 130 of the second tube 104.

The diameters and lengths of the pipes 102, 104 are equal and the diameters of the elbow pipes 118, 120 are smaller than the diameters of the pipes 102, 104 thereby enabling the elbow pipes 118, 120 to easily insert inside the pipes 102, 104, respectively. Also, the valve 114 has a smaller diameter than the diameters of the elbow pipes 118, 120, thereby enabling the valve to easily couple with the elbow pipes 118, 120.

In the present embodiment, the metal attachment 116 along with the pipes 102, 104, elbow pipes 118, 120 and the valve 114 are integrated to the boot 100. Alternatively, the said components can be retrofitted to any conventional boot.

Figure 2A:
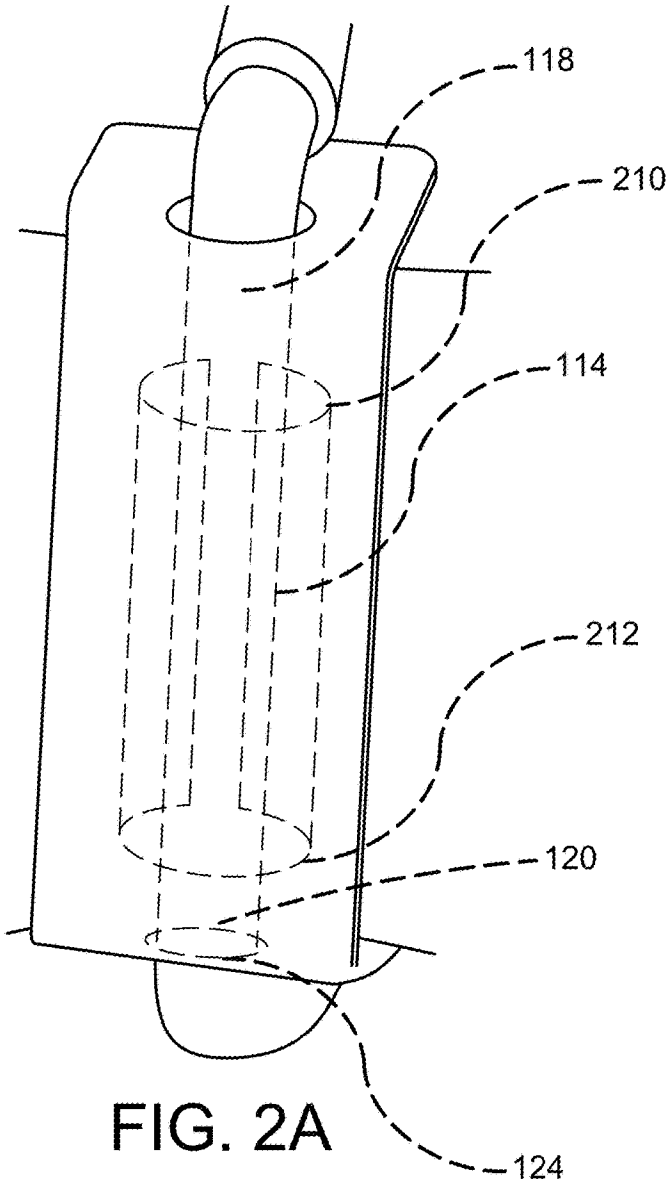
FIG. 2A illustrates a magnified view of the bottom portion of the improved shoe/boot of FIG. 2 in accordance with the disclosed architecture.
Figure 2:
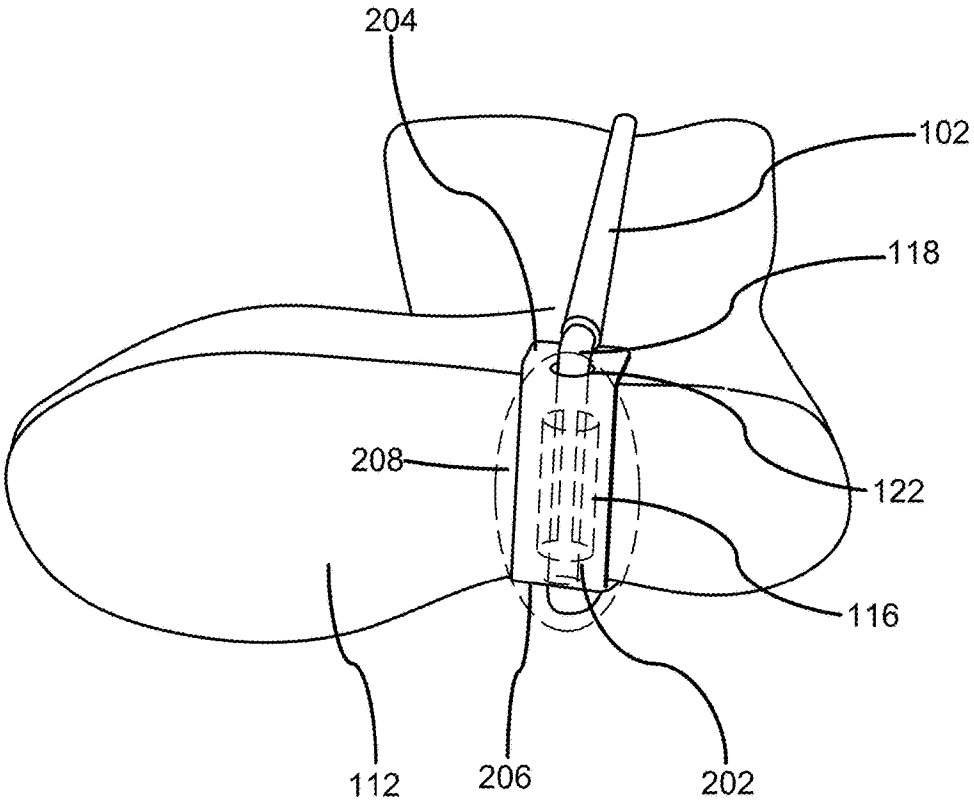
FIG. 2 illustrates a bottom perspective view of one potential embodiment of the suction relieving boot of the present invention in accordance with the disclosed architecture.

FIGS. 2 and 2A illustrate a bottom perspective view of the suction relieving boot 100 of the present invention in accordance with the disclosed architecture. As illustrated, the metal plate 116 has a horizontal portion 202 positioned under the sole 112 such that the horizontal portion 202 forms an arch 208 for accommodating the valve 114. The metal plate 116 also has vertically extending portions 204, 206 extending perpendicularly from the ends of the horizontal portion 202. The vertically extending portions 204, 206 are integrally molded into the boot 100 for secure positioning of the metal plate 116.

The elbow tube 118 passes through the opening 122 to connect to the valve 114 via the hole 210. It should be noted that the second elbow tube 120 passes through the opening 124 to connect to the valve 114 via the hole 212 such that the valve 114 is coupled to both the elbow tubes 118, 120.

The metal plate 116 is made of a durable and lightweight metal such as iron or aluminum and extends across the sole 112 forming an arch. When a wearer of the shoe 100 places a step, the cut along the length of the valve 114 is closed to create a vacuum in the valve 114. Then, when the foot is lifted, the vacuum is released by automatic opening of the valve 114.

Figure 3A:
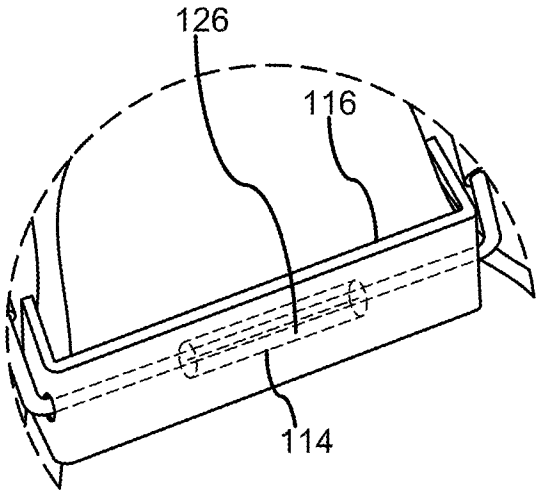
FIG. 3A illustrates a magnified view of the bottom portion of the improved shoe/boot of FIG. 3 in accordance with the disclosed architecture.
Figure 3:
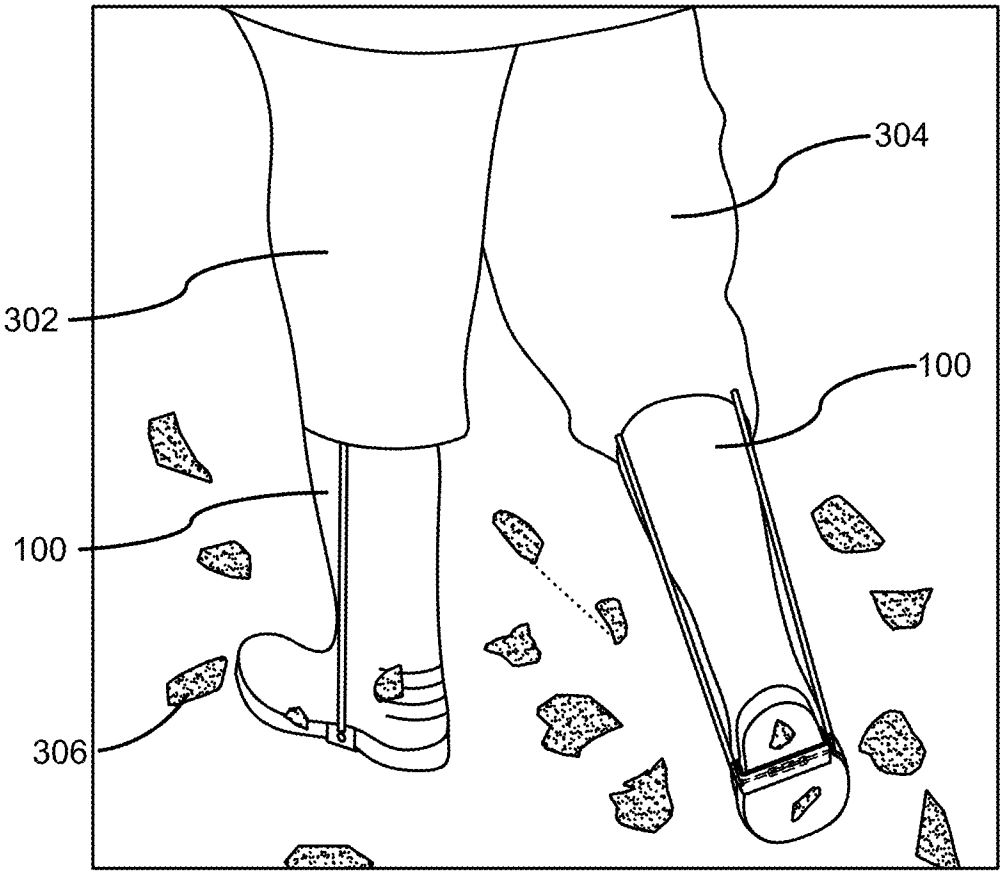
FIG. 3 illustrates a perspective view showing a user wearing one potential embodiment of the boot of the present invention on each leg for easily walking in mud in accordance with the disclosed architecture.

FIGS. 3 and 3A illustrate a perspective view showing a user wearing the boot of the present invention on each leg for easily walking in mud in accordance with the disclosed architecture. A user can wear the boot 100 on each foot 302, 304 so that the user can easily walk in mud 306 or in any other terrain without getting stuck. The left foot 302 is placed in the mud 306 and therefore, the valve 114 creates a vacuum in the arch of the metal plate as the lengthwise cut 126 remains closed. As the right foot 304 is lifted, the closed valve 114 is opened and the vacuum is released, thereby preventing the user from becoming stuck in the mud 306.

The boot 100 is designed to alleviate excessive pressure when walking in water, sand, or mud and is especially useful for farmers, ranchers, anglers, hunters, gardeners, and more. Some of the mud positioned inside the valve 114 can also be released through the pipes 102, 104 wherein the mud passes through the elbow tubes of the boot 100.

Figure 4:
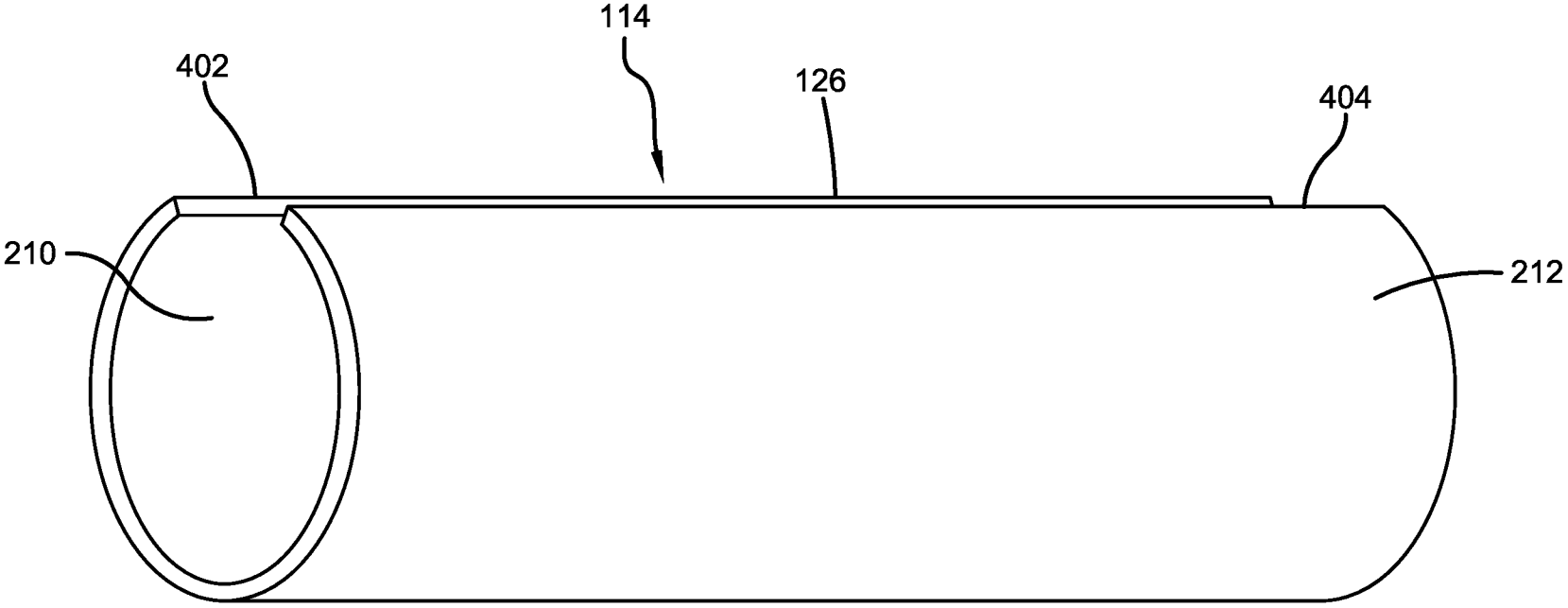
FIG. 4 illustrates a perspective view of the valve used in one potential embodiment of the boot of the present invention in an open state in accordance with the disclosed architecture.

FIG. 4 illustrates a perspective view of the valve used in the boot 100 of the present invention in an open state in accordance with the disclosed architecture. The valve 114 is configured to automatically open and close for preventing the foot of a user from becoming stuck in mud, sand, or other terrain. As illustrated, the valve 114 having the lengthwise cut 126 is in the open state with the cut 126 being opened automatically to release the vacuum upon lifting the boot 100 from the mud, sand, or terrain. The cut 126 becomes closed with the edges 402, 404 touching each other when the boot 100 is placed in mud, sand, or other terrain.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "suction relieving boot", "suction relieving boot", "boot", and "sherlock style boot" are interchangeable and refer to the suction relieving boot 100 of the present invention.

Notwithstanding the forgoing, the suction relieving boot 100 of the present invention can be of any suitable size and configuration as is known in the art without affecting the overall concept of the invention, provided that it accomplishes the above-stated objectives. One of ordinary skill in the art will appreciate that the suction relieving boot 100 as shown in the FIGS. are for illustrative purposes only, and that many other sizes and shapes of the suction relieving boot 100 are well within the scope of the present disclosure. Although the dimensions of the suction relieving boot 100 are important design parameters for user convenience, the suction relieving boot 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A suction relieving boot for prohibiting stuck footwear in surrounding terrain, the suction relieving boot comprising:

a boot having a sole and a first tube and a second tube, wherein said first tube and said second tube are positioned on opposing sides of said boot, and further wherein said first tube and said second tube are independent tubes and each tube extends from said sole of said boot to an upper edge of said boot;

a valve positioned below said sole;

a rigid attachment extending across said sole and over said valve;

a first tube elbow connecting said first tube to said valve; and a second tube elbow connecting said second tube to said valve.

2. The suction relieving boot of claim 1, wherein said rigid attachment is a rectangular metal sheet fastened to said sole.

3. The suction relieving boot of claim 2, wherein said first tube elbow passes through a first opening positioned in said rigid attachment for connecting said first tube to said valve.

4. The suction relieving boot of claim 3, wherein said second tube elbow passes through a second opening positioned in said rigid attachment for connecting said second tube to said valve.

5. The suction relieving boot of claim 4, wherein said first opening is adjacent to a first side of said sole and said second opening is adjacent to an opposing second side of said sole.

6. The suction relieving boot of claim 5, wherein said valve having a lengthwise slit from one terminal end to another terminal end.

7. A suction relieving boot for prohibiting stuck footwear in surrounding terrain, the suction relieving boot comprising:

a boot having a sole and a first tube and a second tube, wherein said first tube and said second tube are positioned on opposing sides of said boot, and further wherein said first tube and said second tube are independent tubes and each tube extends from said sole of said boot to an upper edge of said boot;

a valve positioned below said sole, wherein said valve having a lengthwise slit from one terminal end to another terminal end;

a rigid attachment extending across said sole and over said valve;

a first tube elbow connecting said first tube to said valve at a first end; and a second tube elbow connecting said second tube to said valve at a second end.

8. The suction relieving boot of claim 7, wherein said first tube elbow passes through a first opening positioned in said rigid attachment for connecting said first tube to said valve.

9. The suction relieving boot of claim 8, wherein said second tube elbow passes through a second opening positioned in said rigid attachment for connecting said second tube to said valve.

10. The suction relieving boot of claim 9, wherein said first opening is adjacent to a first side of said sole and said second opening is adjacent to an opposing second side of said sole.

* * * * *